US008453885B2

(12) United States Patent
Breault et al.

(10) Patent No.: US 8,453,885 B2
(45) Date of Patent: Jun. 4, 2013

(54) HAND HELD PERISTALTIC PUMP FOR DISPENSING FLUID FROM A RIGID CONTAINER

(75) Inventors: John P. Breault, New Britain, CT (US); Steven J. Hemsen, Southington, CT (US)

(73) Assignee: Henkel Corporation, Rocky Hill, CT (US)

( * ) Notice: Subject to any disclaimer, the term of this patent is extended or adjusted under 35 U.S.C. 154(b) by 295 days.

(21) Appl. No.: 12/850,132

(22) Filed: Aug. 4, 2010

(65) Prior Publication Data

US 2010/0313996 A1 Dec. 16, 2010

Related U.S. Application Data

(63) Continuation of application No. PCT/US2009/000723, filed on Feb. 5, 2009.

(60) Provisional application No. 61/026,560, filed on Feb. 6, 2008.

(51) Int. Cl.
*B05B 11/00* (2006.01)

(52) U.S. Cl.
USPC ..... 222/214; 222/383.2; 417/474

(58) Field of Classification Search
USPC ..... 222/214, 207, 383.2, 383.1; 417/474, 417/477.1, 477.5–477.9, 477.11
See application file for complete search history.

(56) References Cited

U.S. PATENT DOCUMENTS

| | | | | |
|---|---|---|---|---|
| 4,138,205 | A * | 2/1979 | Wallach | 417/360 |
| 4,232,828 | A * | 11/1980 | Shelly, Jr. | 239/329 |
| 5,064,358 | A * | 11/1991 | Calari | 417/475 |
| 5,693,020 | A * | 12/1997 | Rauh | 604/151 |
| 5,711,457 | A | 1/1998 | Wanbaugh et al. | |
| 6,131,820 | A | 10/2000 | Dodd | |
| 6,578,224 | B1 | 6/2003 | Lawson et al. | |
| 6,752,330 | B2 * | 6/2004 | DiMaggio et al. | 239/337 |
| 7,246,755 | B2 * | 7/2007 | Hornsby et al. | 222/153.13 |
| 7,591,639 | B2 * | 9/2009 | Kent | 417/477.8 |

FOREIGN PATENT DOCUMENTS

| | | |
|---|---|---|
| EP | 1 078 880 A1 | 2/2001 |
| JP | 10258869 | 9/1998 |

* cited by examiner

*Primary Examiner* — Kevin P Shaver
*Assistant Examiner* — Charles P Cheyney
(74) *Attorney, Agent, or Firm* — Steven C. Bauman

(57) ABSTRACT

A fluid dispensing apparatus includes an operable peristaltic pump. The pump supports a rigid container which includes an aggressive fluid which is to be dispensed from the container. A vent tube and a dispensing tube extends from the container through the pump. Operation of the pump causes fluid to be pumped out from the container through the dispensing tube while air is pumped into the container through the vent tube. This equalizes pressure in the container and allows fluid to be dispensed from a rigid container.

13 Claims, 5 Drawing Sheets

HAND HELD PERISTALTIC PUMP FOR DISPENSING FLUID FROM A RIGID CONTAINER

FIELD OF THE INVENTION

The present invention relates generally to a dispensing apparatus for dispensing fluid from a container. More particularly, the present invention relates to a peristaltic pump for dispensing adhesive from a rigid container.

BACKGROUND OF THE INVENTION

In certain applications, it is often necessary to apply an accurate amount of an adhesive to bond a part to a workpiece. Many adhesive containers are designed so that a relatively accurate amount of adhesive can be dispensed from the container under manual squeeze pressure. A variety of dispensing apparatuses such as pumps and guns, which are designed to easily and accurately dispense a measured amount of adhesive.

In certain situations, due to the nature of the adhesive employed, it is necessary to design the dispensing mechanism to assure that the components of the mechanism do not come in contact with the adhesive itself. Depending upon the adhesive, such contact may either adversely effect the adhesive, adversely effect the components of the dispensing apparatus, or both. Such a situation is particularly evident with the use of cyanoacrylate ("CA") adhesives.

In such situations, it has been common to use a peristaltic pump to dispense the adhesive from a container. A peristaltic pump is a positive displacement pump used to dispense fluid from a container through a flexible tube. Peristaltic pumps are typically used to pump various fluids, such a clean or sterile fluid, where there is a desire for the pump not to contaminate the fluid, or to pump aggressive fluids, such as adhesives so that the fluid cannot contaminate the pump. However, as the peristaltic pump operates under closed conditions, the container for the fluid must be a collapsible container so that as the fluid is pumped from the container the container will collapse around the remaining contents thereof.

In situations where fluid is provided in a rigid non-collapsible container, the use of a peristaltic pump becomes difficult inasmuch as air cannot enter the rigid container to replace the volume of fluid dispensed. Venting the rigid container directly to atmosphere is not a viable option where the fluid is an adhesive such as a CA adhesive which cures in the presence of air. This has resulted in the inability to dispense such adhesives from a sealed rigid container using a peristaltic pump.

SUMMARY OF THE INVENTION

The present invention provides a fluid dispensing apparatus. The apparatus includes an operatable peristaltic pump. The pump supports a rigid container which includes a fluid which is to be dispensed. A separate dispensing tube as well as a vent tube extends from the container through the pump. Operation of the pump causes fluid to be pumped out from the container through the dispensing tube and air is pumped into the container through the vent tube so as to equalize pressure in the container. The present invention is particularly useful in dispensing a fluid adhesive.

In a preferred embodiment of the present invention, the peristaltic pump is rotational pump having a circumferential surface in rotational engagement with the dispensing tube and the vent tube. A dispensing nozzle affixed to the end of the dispensing tube provides for dispensing a measured amount of adhesive fluid.

DETAILED DESCRIPTION OF THE PREFERRED EMBODIMENTS

Figure 1:
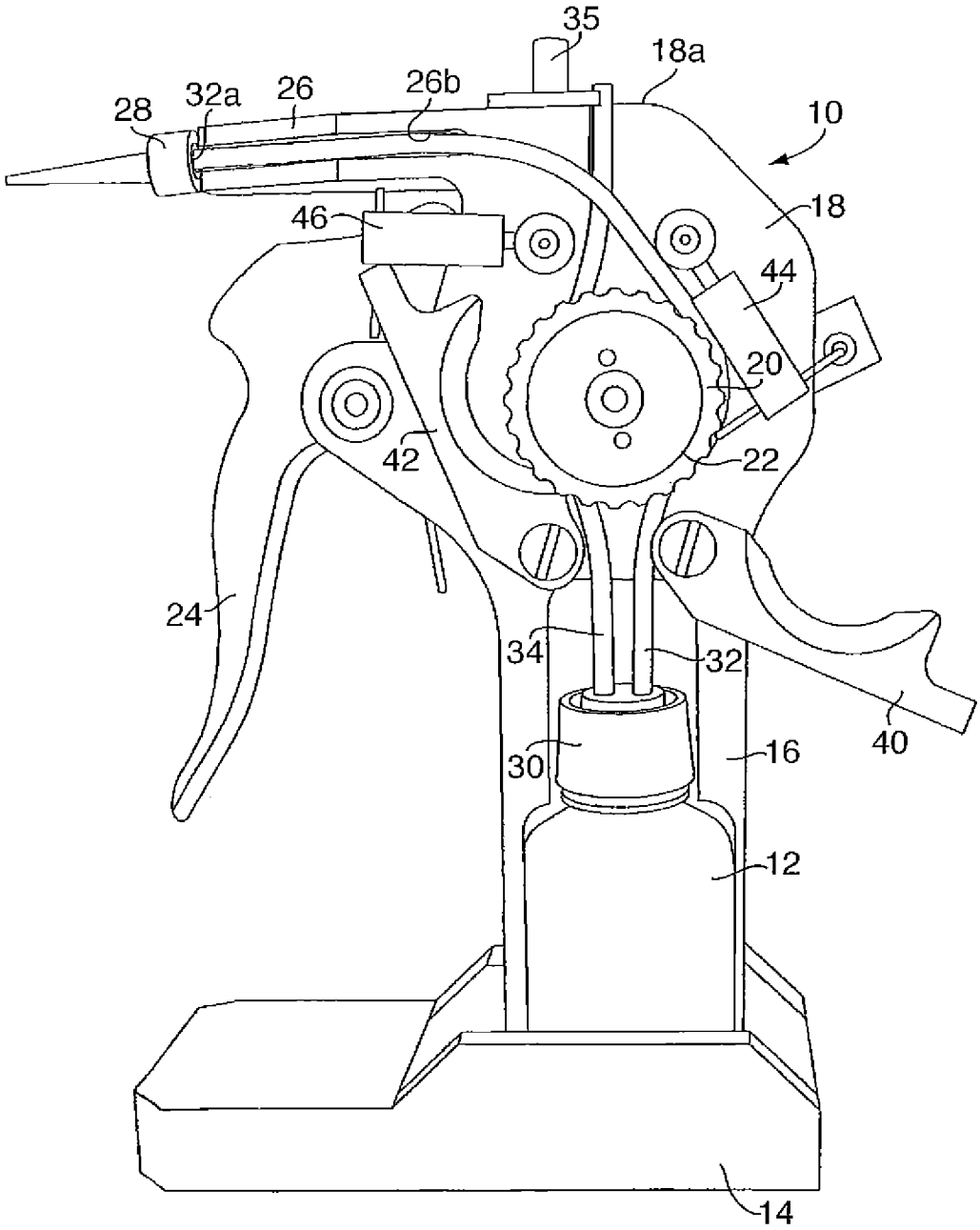
FIG. 1 is a perspective showing of the hand-held peristaltic pump of the present invention.

In order to dispense a measured amount of fluid product, particularly when the fluid product is an adhesive such as a cyanoacrylate (CA) adhesive, the present invention provides a peristaltic pump. As is known, peristaltic pumps may be used to pump various fluids where there is a desire to prevent contact between the fluid itself and the moving components of the pump. Such a need is particularly evident with aggressive fluids, such as adhesives, where contact between the working components of the pump and the adhesive can adversely effect both the operation of the pump as well as the effectiveness of the adhesive. As most peristaltic pumps operate under closed conditions, the use of peristaltic pumps to dispense fluids have been limited to fluids contained in a collapsible container, as air within the container cannot be expelled. The present invention provides a peristaltic pump which operates to dispense fluids from a rigid container.

Referring to the drawings, pump assembly 10 of the present invention includes a peristaltic pump which may be used to dispense a measured amount of fluid such as an aggressive adhesive fluid, more particularly, cyanoacrylate (CA) from a rigid container 12. The pump assembly 10 includes a base 14 and an upstanding member 16 which supports the working components thereof. Base 14 is designed so that the pump assembly 10 may be supported on a level surface and used in a stationary position. In the alternative, the pump assembly 10 may be used as a hand-held dispenser. Base 14 and the upstanding member support the rigid container 12 in a fixed position therebetween.

Figure 2:
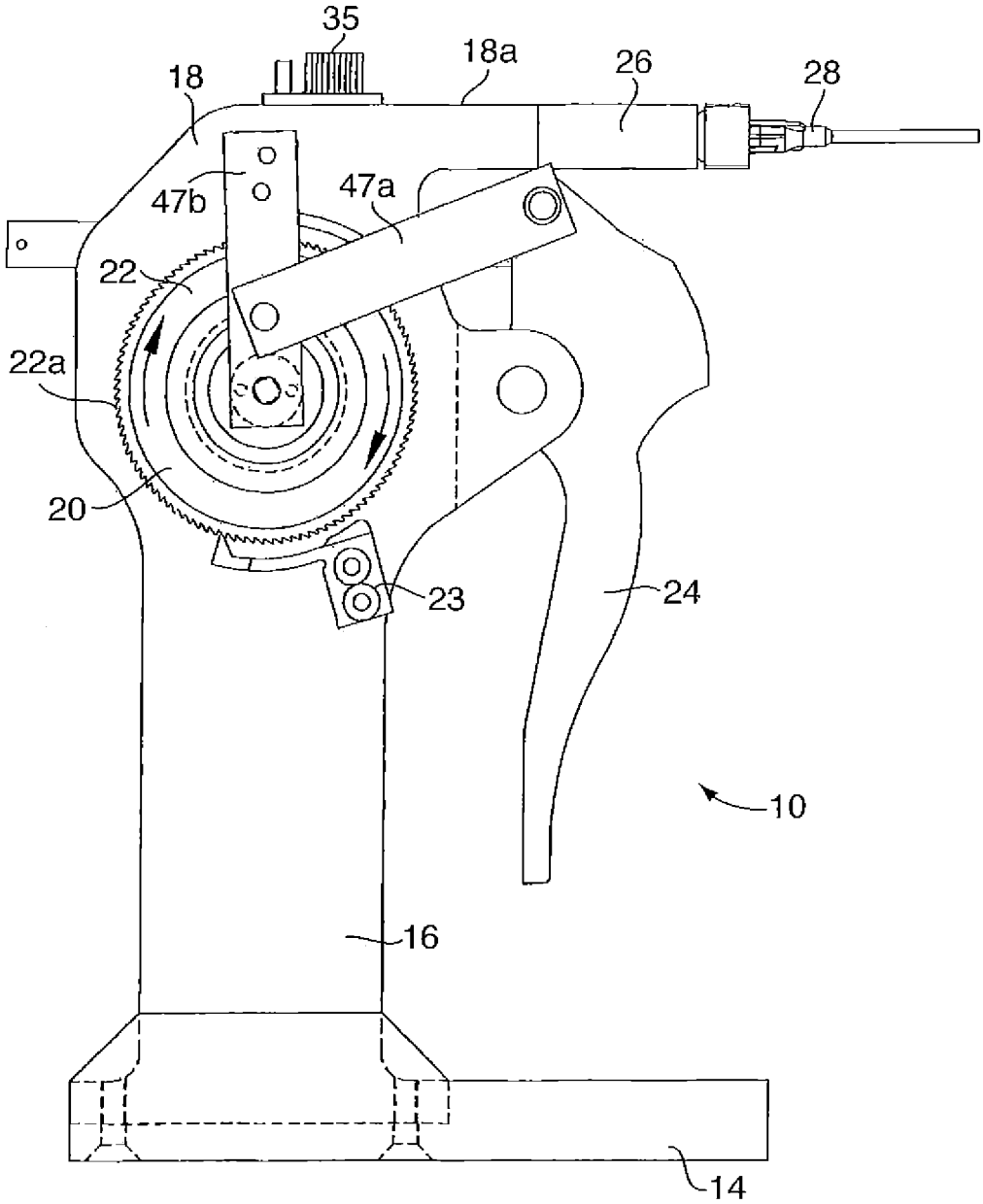
FIGS. 2, 3 and 4 show, respectively, rear, front and side elevational views of the hand-held peristaltic pump of FIG. 1.
Figure 3:
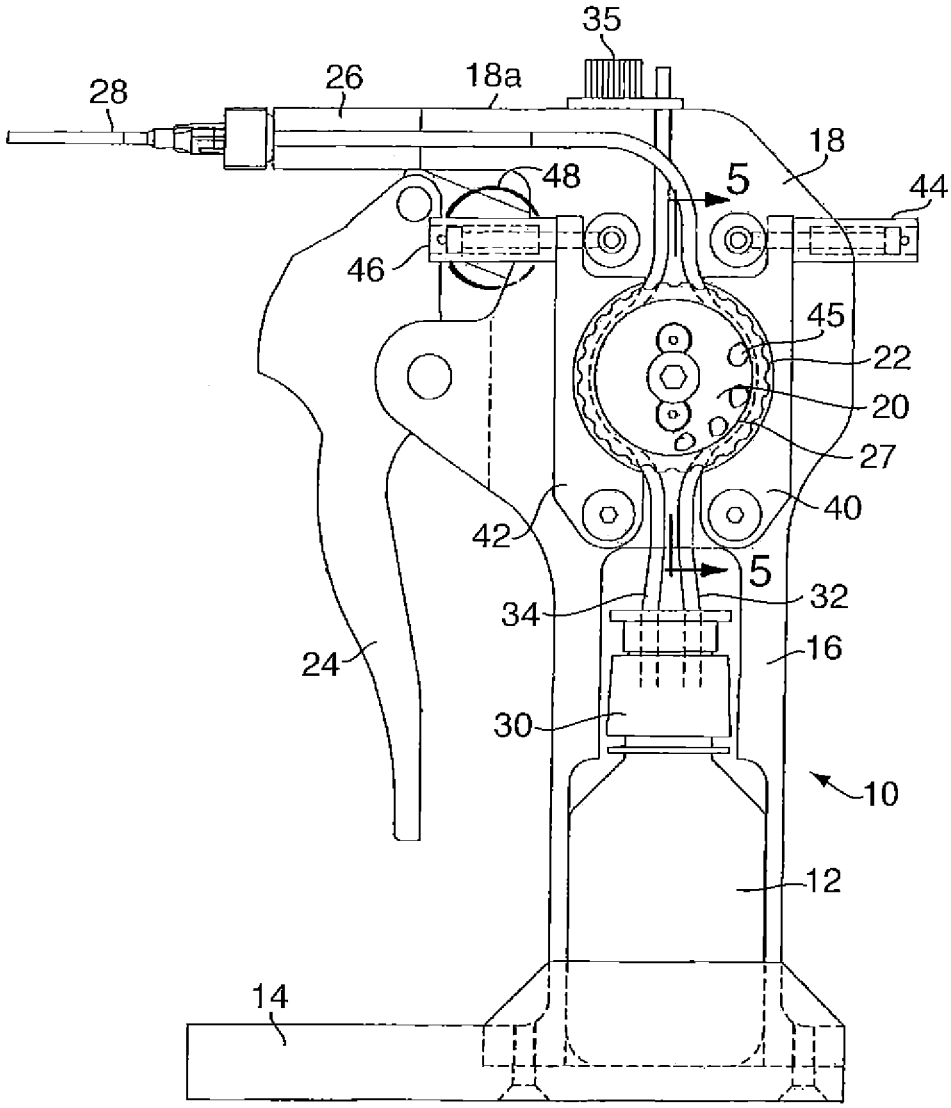
Figure 4:
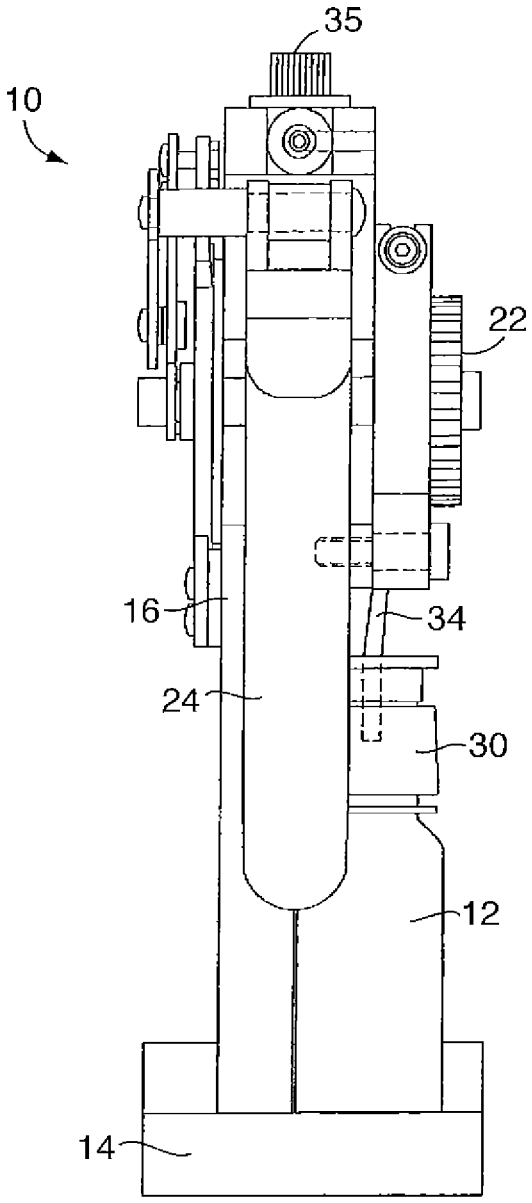

An upper portion 18 of the upstanding member 16 supports the components of a rotary peristaltic pump 20. The pump 20 includes a rototable wheel 22 which is actuated by a trigger 24. The trigger 24 serves to effect rotation of wheel 22 (FIG. 2) in a manner well known in the art. As shown in FIG. 2, the wheel 22 includes a ratchet surface 22*a* which is engageable with a pawl 23 to provide one way rotation of wheel 22. As shown in FIG. 3, the wheel includes a bearing surface 27, which as will be described in further detail hereinbelow, supports in close engagement, tubes extending from rigid container 12. The upper portion 18 of upstanding member 16 further provides a dispensing arm 26 which accommodates a nozzle 28 for dispensing of the fluid.

Container 12 is a rigid plastic container having a closure cap 30 which encloses the upper end of the open ended container 12. A pair of tubes 32, 34 extend outwardly from cap 30. A dispensing tube 32 extends from the interior of container 12 up through cap 30 and around wheel 22 through arm 26 where its distal end 26*a* is attached to nozzle 28. A vent tube 34 also extends from the interior of container 12 around the opposite side of wheel 22 and extends externally of an upper surface 18*a* of upper extent 18. The vent tube 34 may be fixedly supported at an end thereof by a holding mechanism 35. The tubes 32 and 34 may be supported against the bearing surface 27 of rotational wheel 22 by a pair of displaceable clamps 40 and 42. As shown in FIG. 3, the clamps may be held against the wheel 22 to force the tubes against the bearing surface 27 of the wheel 22 by latches 44 and 46. While the cap 30 and tubes 32, 34 may be supplied as separate items which may be assembled, it is contemplated that the present invention may provide a cap 30 with tubes 32, 34 attached thereto in sealed fashion. This arrangement of a unified cap and tubes allows sealed attachment to the container. In addition, the entire cap/tube assembly may be removed and replaced by another cap/tube assembly. It is further contemplated that the cap and tubes are sealed preventing accidental spillage.

Referring to FIGS. 1 and 3, the operation of the peristaltic pump assembly of the present invention is shown. Rigid container 12 which may contain a quantity of a fluid product such as a CA adhesive is positioned in the base 14 of pump assembly 10. Dispensing and vent tubes 32 and 34 inserted through openings in cap 30 so that the tubes extend into the interior container 12. It is contemplated that dispensing tube 32 is inserted to a depth near the bottom of the container so that most, if not all, of the contents of the container 12 can be dispensed. Vent tube 34 is inserted to a position at the upper end of the interior of container 12 so as to provide a vent to the interior of the container. Both tubes 32 and 34 extend upwardly around bearing surface 27 of rotational wheel 22. Vent tube 34 is then secured at the upper end of upper portion 18 of pump assembly and secured by holding mechanism 35. Thus, vent tube 34 is fixed to the pump assembly so that the vent tube does not move upon rotation of wheel 22.

In a similar manner, dispensing tube 32 extends upwardly around the opposite side of wheel 22 against bearing surface 27. The dispensing tube 32 is fixed in cap 30 by an interface fit then extends laterally along a channel 26*b* in arm 26 and the end 32*a* of tube 32 is attached to a dispensing nozzle 28 which fixes the position of the vent tube 32 thereat. This also prevents the dispensing tube 32 from moving upon rotation of wheel 22.

Once the tubes 32 and 34 are fixedly positioned, clamps 40 and 42 may be brought up into position against the tubes to place the tubes in engagement with the bearing surface 27 of wheel 22. The position of the clamps are fixed by latches 44 and 46 to hold the tubes against the bearing surface 27 of wheel 22. FIG. 3 shows the pump 10 in position to dispense fluid product therefrom.

Figure 5:
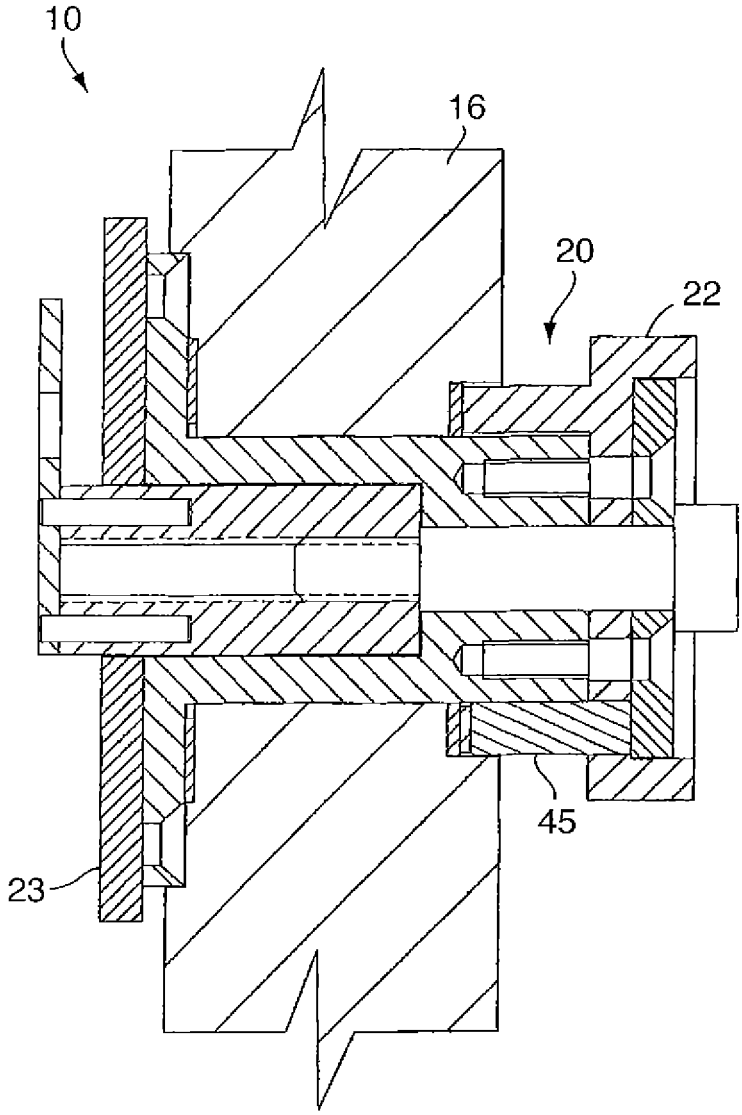
FIG. 5 is a partial sectional top view of the pump of FIG. 1.

Actuation of trigger 24 causes rotation of wheel 22 (FIG. 2). As is well known with peristaltic pumps, the bearing surface 27 of wheel 22 includes a plurality of circumferentially arranged spaced part pins 45 (FIG. 5). The pins 45 may be rotatably supported about the bearing surface 27 of wheel 22. As the wheel is rotated, the pins 45 of the bearing surface 27 bear against dispensing tube 32 to cause movement of fluid from container 12 up through dispensing tube 34 and out through dispensing nozzle 28.

During the dispensing of the product, the pins 45 of bearing surface 27 also bear against vent tube 34 to force the air from the vent tube 34 into the interior of container 12. Thus, as fluid is being dispensed through dispensing tube 32, an equivalent amount of air is being introduced back into container 12. This helps maintain pressure within the rigid container 12 allowing fluid to be dispensed from dispensing tube 32.

The ability to vent air out of rigid container 12 during the dispensing of fluid therefrom allows the peristaltic pump assembly 10 to be used in combination with the sealed non-collapsible container. Moreover, as may be appreciated, the use of the peristaltic pump allows dispensing of the fluid from the rigid container without the fluid itself coming in contact with the operational components of the pump thereby preventing contamination of the pump components and the fluid itself.

While the invention has been described in relationship to the preferred embodiments, it will be understood by those skilled in the art that various changes may be made without deviating from the fundamental nature and scope of the invention as defined in the appended claims.

What is claimed is:

1. A peristaltic pump assembly for dispensing a fluid comprising:

a sealed non-collapsible container for containing said fluid;

a pump housing for supporting said container;

a rotatable wheel supported by said housing;

a dispensing tube extending from said container and in engagement with said wheel;

a vent tube extending from said container and in engagement with said wheel;

a trigger for effecting rotation of said wheel thereby pumping said fluid from said container through said dispensing tube and pumping air through said vent tube into said container.

2. A pump assembly of claim 1 further including means for releasably maintaining said vent tube and said dispensing tube in said engagement with said wheel upon rotation thereof.

3. A pump assembly of claim 2 wherein said maintaining means includes: a pair of movable clamps one clamp of said pair being engageable within said dispensing tube and the other clamp of said pair being in engageable with said vent tube.

4. A pump assembly of claim 1 wherein said rotatable wheel includes a circumferential surface for engagement with said dispensing tube and said vent tube.

5. A pump assembly of claim 4 wherein said circumferential surface supports a plurality of circumferentially spaced pins for engagement with said dispensing tube and said vent tube upon rotation of said wheel.

6. A pump assembly of claim 5 wherein said pins are rotatably supported in said circumference of said wheel.

7. A pump assembly of claim 1 wherein said vent tube and said dispensing tube are fixedly positioned on said pump housing.

8. A pump assembly of claim 1 wherein said fluid is an adhesive.

9. A pump assembly of claim 3 further including an end clamp for fixedly positioning said vent tube preventing movement thereof upon rotation of said wheel.

10. A pump assembly of claim 1 further including a dispensing nozzle affixed to an end of said dispensing tube for dispensing a measured amount of said fluid.

11. A pump assembly of claim 10 wherein said dispensing nozzle is fixed to said pump housing preventing movement thereof upon rotation of said pump.

12. A pump of claim 1 wherein said container includes a cap for sealed attachment thereto, said cap accommodates said dispensing tube and said vent tube extending from said container.

13. A pump of claim 1 wherein said vent tube, said dispensing tube and said cap are arranged in a unified structure which is removably positionable on said container.

* * * * *